US010426285B2

(12) United States Patent
Miki

(10) Patent No.: US 10,426,285 B2
(45) Date of Patent: Oct. 1, 2019

(54) BELT HANGER, AND BELT HANGING STRUCTURE USING THE SAME

(71) Applicant: Yonosuke Miki, Hyogo (JP)

(72) Inventor: Yonosuke Miki, Hyogo (JP)

(73) Assignee: Yonosuke Miki, Hyogo (JP)

( * ) Notice: Subject to any disclaimer, the term of this patent is extended or adjusted under 35 U.S.C. 154(b) by 113 days.

(21) Appl. No.: 15/692,593

(22) Filed: Aug. 31, 2017

(65) Prior Publication Data

US 2018/0064276 A1 Mar. 8, 2018

(30) Foreign Application Priority Data

Sep. 5, 2016 (JP) ..... 2016-172612
Feb. 27, 2017 (JP) ..... 2017-035170

(51) Int. Cl.
*A47G 25/74* (2006.01)
*A47F 7/12* (2006.01)
*A47F 5/00* (2006.01)

(52) U.S. Cl.
CPC ..... *A47G 25/743* (2013.01); *A47F 5/0006* (2013.01); *A47F 7/12* (2013.01)

(58) Field of Classification Search
CPC ..... A47G 25/74; A47G 25/743; A47G 25/16; A47F 5/00; A47F 5/0006; A47F 2005/0012; A47F 7/12
USPC ..... D9/415
See application file for complete search history.

(56) References Cited

U.S. PATENT DOCUMENTS

| | | | | |
|---|---|---|---|---|
| 4,453,655 | A | 6/1984 | Smilow et al. | |
| D387,980 | S * | 12/1997 | Snitzer | D9/415 |
| 5,799,843 | A * | 9/1998 | Hsu | A47G 25/743 223/85 |
| 7,448,520 | B2 * | 11/2008 | Kolton | A47F 5/0006 223/85 |
| 2004/0195279 | A1 * | 10/2004 | Mazzucchelli | A47F 7/12 223/87 |
| 2015/0076094 | A1 * | 3/2015 | Allahverdian | A47G 25/743 211/105.1 |
| 2015/0113770 | A1 | 4/2015 | Laatz | |

FOREIGN PATENT DOCUMENTS

| | | | |
|---|---|---|---|
| JP | S46-6033 U | | 3/1971 |
| JP | 5-15864 U | | 3/1993 |
| JP | 936365 S | | 10/1995 |
| JP | 2009-183611 A | | 8/2009 |
| JP | 2010178836 A | * | 8/2010 |

OTHER PUBLICATIONS

Office Action for Japanese Patent Application No. 2017-035170 issued by the Japanese Patent Office dated Apr. 27, 2017.

* cited by examiner

*Primary Examiner* — Ismael Izaguirre
(74) *Attorney, Agent, or Firm* — Martin & Ferraro, LLP

(57) ABSTRACT

A belt hanger includes a support member capable of supporting at least a locking pin of a pin-type belt that includes a single-pin buckle, and the belt hanger suspends and holds the pin-type belt by supporting the locking pin with use of the support member. The support member includes a first support portion that can simultaneously support a plurality of portions of the locking pin that are separated in the length direction of the locking pin.

8 Claims, 6 Drawing Sheets

BELT HANGER, AND BELT HANGING STRUCTURE USING THE SAME

CROSS-REFERENCE TO RELATED APPLICATIONS

This application claims priority to and the benefit of Japanese Patent Application Nos. JP2016-172612 filed Sep. 5, 2016 and JP2017-035170 filed Feb. 27, 2017; all of which are incorporated by reference herein.

FIELD OF THE INVENTION

The present disclosure relates to a belt hanger that includes a support member capable of supporting at least a locking pin of a pin-type belt provided with a single-pin buckle, and that suspends and holds the pin-type belt by supporting the locking pin with use of the support member, and the present disclosure also relates to a belt hanging structure that suspends and holds a pin-type belt that includes a single-pin buckle with use of the belt hanger.

BACKGROUND

As one example of this type of belt hanger, Japanese Registered Design No. 936365 discloses a belt hanger that includes a plate-shaped portion provided with a through hole for insertion of a locking pin of a pin-type belt provided with a single-pin buckle, and a fold-back portion that extends along the outer circumference of the plate-shaped portion and can be folded back independently of the plate-shaped portion. According to this belt hanger, it is possible to suspend a pin-type belt that includes a single-pin buckle by passing the belt hanger through the buckle, inserting the locking pin through the through hole of the plate-shaped portion such that the locking pin is supported by the plate-shaped portion, and then folding back the fold-back portion so as to sandwich the buckle, and thus the buckle is supported by the fold-back portion.

SUMMARY OF THE INVENTION

However, with the conventional belt hanger described above, it is not easy to perform the two steps of inserting the locking pin through the through hole of the plate-shaped portion and folding the fold-back portion so as to sandwich the buckle, and therefore troublesome attachment operations needs to be performed. Also, the fold-back portion is subjected to a large load due to be folded back, and the fold-back portion is easily damaged. Moreover, due to providing not only the plate-shaped portion, but also the fold-back portion that extends along the outer circumference of the plate-shaped portion, the overall size of the hanger necessarily increases, and it is also necessary to provide the belt hanger with a fixing means for fixing the fold-back portion in the folded-back state, for example, thus raising the production cost to a certain extent.

To address this, it is conceivable to omit the fold-back portion, provide only the plate-shaped portion, and support only the locking pin, but if only the locking pin is supported, the belt hanger swings about the support point relative to the belt, and the usability degrades for store employees who hang belts for display and customers who pick up displayed belts.

In view of this, there is desire for a belt hanger that can achieve size reduction and cost reduction while also improving durability and usability for store employees, customers, and the like, as well as a belt hanging structure employing this belt hanger.

A belt hanger according to an aspect of the present disclosure is a belt hanger including a support member capable of supporting at least a locking pin of a pin-type belt that includes a single-pin buckle, the belt hanger suspending and holding the pin-type belt by supporting the locking pin with use of the support member, wherein the support member includes a first support portion capable of simultaneously supporting a plurality of portions of the locking pin that are separated in a length direction of the locking pin.

According to this configuration, a plurality of portions of the locking pin in the length direction are supported by the first support portion, and therefore it is possible to effectively suppress swinging of the belt hanger about the support point relative to the belt. Also, there is no need to provide a fold-back portion as in conventional technology, thus making it possible to achieve size reduction, cost reduction, and an improvement in durability. Accordingly, it is possible to achieve size reduction and cost reduction while also improving durability and usability for store employees, customers, etc. of belt attachment and removal, low tendency of swinging, low tendency of falling during transport, etc.).

DETAILED DESCRIPTION

First Embodiment

Figure 1:
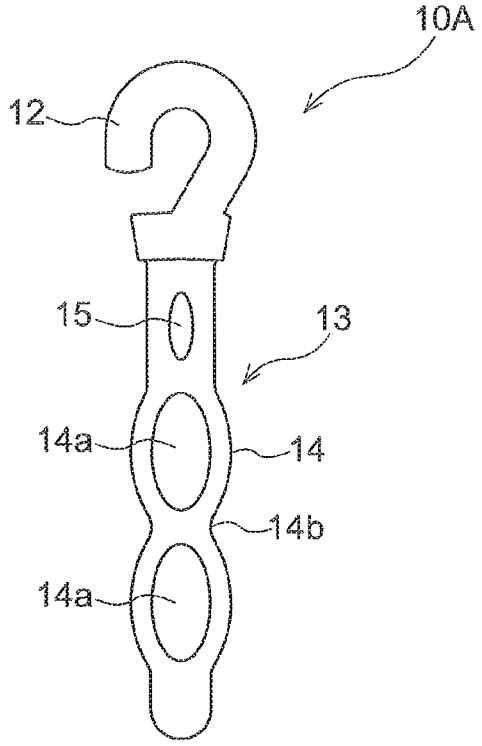
FIG. 1 is a front view of a belt hanger according to a first embodiment.
Figure 2:
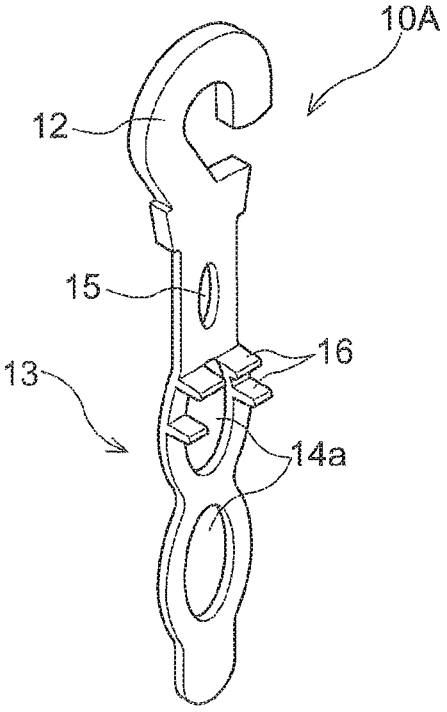
FIG. 2 is a perspective view of the back side of the belt hanger according to the first embodiment.
Figure 3:
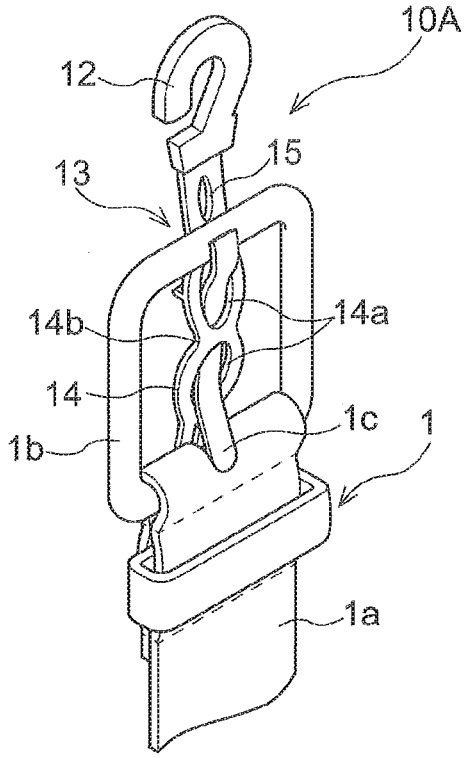
FIG. 3 is a diagram showing a state where the belt hanger according to the first embodiment is used with a pin-type belt that includes a single-pin buckle.

A first embodiment of a belt hanger according to the present disclosure will be described below with reference to the drawings. As shown in FIGS. 1 to 3, a belt hanger 10A according to the present embodiment includes a hook portion 12 for being hung on a hook (long and thin rod-shaped portion) such as a rod hook for display, or on a fixture or the like that includes many rod-shaped pins, and a support member 13 that is capable of supporting a locking pin 1*c* of a pin-type belt 1 that includes a belt 1*a* and a single-pin buckle 1*b*. The belt hanger 10A suspends and holds the pin-type belt 1 by supporting the locking pin 1*c* with use of the support member 13.

As shown in FIGS. 1 to 3, the support member 13 includes a first support portion 14 that can simultaneously support a plurality of portions of the locking pin 1*c* that are separated in the length direction of the locking pin 1*c*. Specifically, the first support portion 14 has a flexible plate-shaped member and two through holes 14*a* that are provided in the surface of the plate-shape member and are arranged side-by-side in the length direction of the locking pin 1*c*, and thus the first support portion 14 has a simple configuration in which merely through holes are provided in a plate-shaped member. Also, the through holes 14*a* are shaped as elliptical holes whose major axis extends in the length direction, and the length of each of the through holes 14*a* in the length direction is greater than the thickness of the locking pin 1*c* (thickness in a direction perpendicular to the buckle 1*b* in the state where the leading end of the locking pin 1*c* is arranged in the buckle 1*b*). Also, in the present embodiment, the first support portion 14 has a shape in which ring-shaped members that define the through holes 14*a* are connected in the length direction, and accordingly, a portion (decreased-width portion) 14*b* of the first support portion 14 that is located between the two through holes 14*a* decreases in width along the shape of the through holes 14*a*.

As shown in FIG. 3, according to the first support portion 14, by inserting the locking pin 1*c* through the lower through hole 14*a* from a first side (front side) to a second side (back side), and then inserting the locking pin 1*c* through the upper through hole 14*a* from the second side (back side) to the first side (front side) such that the locking pin 1*c* is inserted through each of the two through holes 14*a*, the locking pin 1*c* can be supported at a plurality of (two in the present embodiment) portions in the length direction. In this way, a plurality of portions (two in the present embodiment) of the locking pin 1*c* in the length direction are supported by the first support portion 14, and therefore it is possible to effectively suppress swinging of the belt hanger 10A about the support point relative to the belt. Also, in the present embodiment, the entirety of the belt hanger 10A, including the first support portion 14, can be formed from an elastic material such as a resin, and therefore as shown in FIG. 3, even when the locking pin 1*c* is inserted into the through holes 14*a*, only the first support portion 14 undergoes deformation, and the hook portion 12 can be aligned with the buckle 1*b*, thus facilitating display of the belt.

Also, due to the length of each of the through holes 14*a* being longer than the thickness of the locking pin 1*c*, the locking pin 1*c* can be inserted while being inclined relative to the through holes 14*a*, and the bending angle at the decreased-width portion 14*b* is reduced. Also, the bending portion decreases in width, thus making that portion (decreased-width portion 14*b*) easier to bend, and making it easier to remove the belt hanger 10A from the pin-type belt 1 by holding the decreased-width portion 14*b* from the left and right sides. In this way, the bending angle of the decreased-width portion 14*b* can be reduced, thus making it possible to easily perform the operations of attachment and removal of the belt hanger 10A to and from the pin-type belt 1, and also making it possible to improve the durability of the belt hanger 10A (decreased-width portion 14*b*).

Also, the support member 13 is configured so as to be able to suspend and hold various types of belts other than the pin-type belt 1 shown in FIG. 3. First, in order to suspend and hold a belt that includes a so-called top buckle (a buckle itself provided with a locking protrusion portion for insertion into a belt hole), an elliptical locking hole 15 is provided above the through holes 14*a* of the first support portion 14, and the aforementioned belt can be suspended and held by the locking protrusion portion being inserted through and locked in the locking hole 15. Conventionally, the locking hole 15 for insertion of the locking protrusion portion has had a × shape, a + shape, or a ○ shape with cuts therein, but the locking hole 15 of the present embodiment is elliptical, thus making it possible to achieving higher durability than conventionally possible when the locking protrusion portion has been inserted into the locking hole 15. Specifically, with a conventional shape such as a × shape, the size of the locking hole is set according to the size of the locking protrusion portion such that the locking protrusion portion is locked therein, but when a locking protrusion portion that is larger than the intended size is inserted, the locking hole is subjected to an excessively high load and readily cracks. In contrast, by employing an elliptical shape as in the present embodiment, if the vertical length (major axis direction) is increased while setting the horizontal width (minor axis direction) according to the size of the locking protrusion portion such that the locking protrusion portion is locked, it is possible to increase the tolerable amount of deformation of the locking hole 15, and therefore the locking hole 15 of the present embodiment has higher durability when the locking protrusion portion has been inserted into the locking hole 15.

Figure 4:
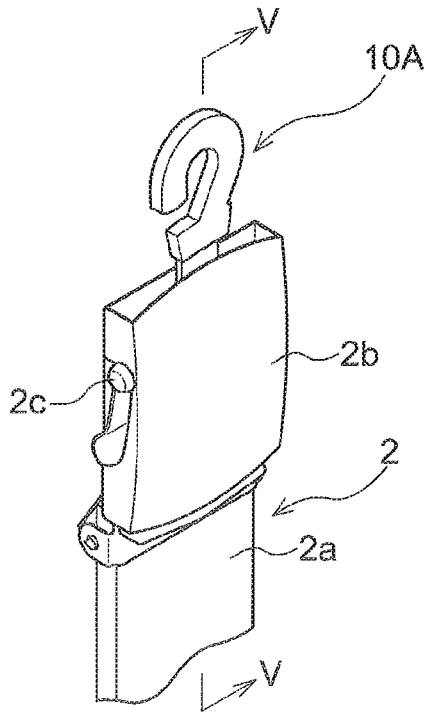
FIG. 4 is a diagram showing a state where the belt hanger according to the first embodiment is used with a buckle-type belt that includes a GI buckle.
Figure 5:
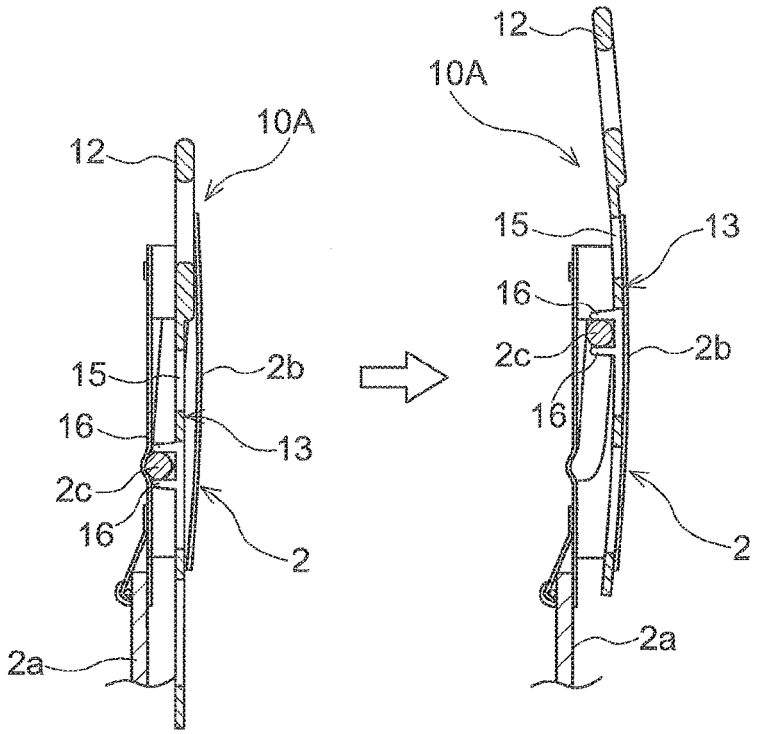
FIG. 5 is a diagram showing a state where the belt hanger according to the first embodiment is used with the buckle-type belt that includes the GI buckle.
Figure 6:
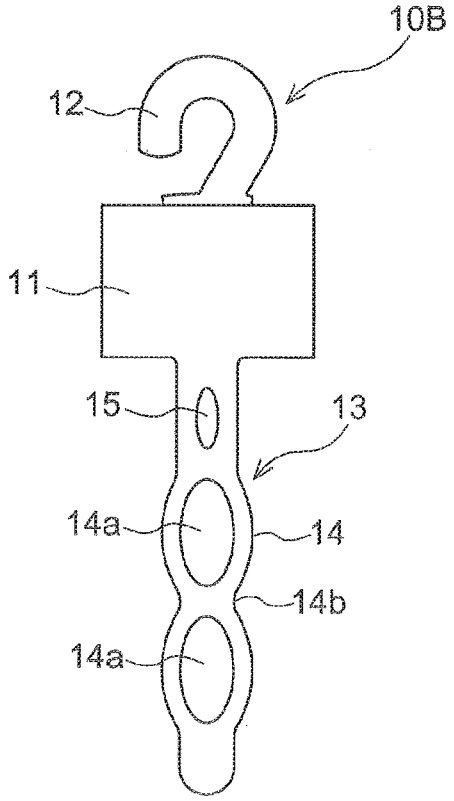
FIG. 6 is a front view of another belt hanger according to the first embodiment.

Furthermore, as shown in FIG. 2, support pieces (second support portions) 16 are provided on the back side of the first support portion 14 so as to protrude from the back surface of the first support portion 14 in order to suspend and hold so-called buckle-type belts 2 and 3 shown in FIGS. 4 and 5 (specifically, buckle-type belt 2 that respectively include belt 2*a*, buckle 2*b*, and pressing fixture 2*c* that sandwich the belt 2*a* along with the buckle 2*b* and fix the belt 2*a* to the buckle 2*b* by pressing the belt 2*a* against the buckle 2*b*).

Note that the buckle-type belt 2 includes a so-called GI buckle 2*b*, and the belt 2*a* is fixed to the GI buckle 2*b* by inserting the belt 2*a* between the GI buckle 2*b* and the rod-shaped pressing fixture 2*c* and then sliding the pressing fixture 2*c* so as to press the belt 2*a* against the GI buckle 2*b*.

Also, pairs of upper and lower support pieces 16 protrude from the support member 13 on the left and right sides at the upper portion of the upper through hole 14*a*, and these support pieces 16 are support pieces for the buckle-type belt 2. More specifically, in the present embodiment, the upper and lower support pieces 16 in each pair are separated in the vertical direction (this term means the vertical direction when the buckle-type belt 2 is suspended and held, and the same follows hereinafter) in accordance with the width of the pressing fixture 2*c* in the vertical direction (in the present embodiment, the support pieces are separated in the vertical direction by a distance that is approximately the same as the width of the pressing fixture 2*c* in the vertical direction), and the pressing fixture 2*c* can be supported by arranging the pressing fixture 2*c* between the pairs of upper and lower support pieces 16. Also, the support member 13 is a member that has flexibility along the vertical direction. According to the belt hanger 10A having this configuration, the buckle-type belt 2 is supported by passing the belt hanger 10A through the GI buckle 2*b* on the lower side (or upper side) of the GI buckle 2*b*, and supporting the pressing fixture 2*c* with the pairs of upper and lower support pieces 16 in a state where the pressing fixture 2*c* is arranged between the upper and lower support pieces 16 and the support member 13 is bent in an arc shape with the support pieces 16 on the inward side as shown in FIG. 5, thus effectively improving stability when suspending and holding the buckle-type belt 2. Here, being separated in the vertical direction in accordance with the width of the pressing fixture 2*c* in the vertical direction refers to a state in which the upper and lower support pieces 16 in each pair are separated in the vertical direction by a distance that allows the pressing fixture 2*c* to be arranged between the upper and lower support pieces 16, and also allows the pressing fixture 2*c* to be clamped by the pairs of upper and lower support pieces 16 in the state where the support member 13 is bent into an arc shape with the support pieces 16 on the inward side.

More specifically, first, the support pieces 16 are separated by a distance that corresponds to the width of the pressing fixture 2*c*, and therefore movement of the pressing fixture 2*c* relative to the belt hanger 10A is restricted when the pressing fixture 2*c* is arranged between the pairs of upper and lower support pieces 16. Also, normally, a surface 2*b*A on the front side of the GI buckle 2*b* of the buckle-type belt 2 (the surface that faces outward when the belt is worn) is shaped as an arc that protrudes toward the front side along the vertical direction as shown in FIG. 5, and due to the support member 13 being a member that has flexibility along the vertical direction, when the pressing fixture 2*c* is arranged between the support pieces 16 and the support member 13 is positioned between the GI buckle 2*b* and the pressing fixture 2*c*, the support member 13 becomes bent in an arc shape that extends along the GI buckle 2*b* with the support pieces 16 on the inward side. When the tips of the pairs of support pieces 16 attempt to move in the direction of approaching each other as the support member 13 bends, the support pieces 16 apply clamping force to the pressing fixture 2*c* that is arranged between the support pieces 16. As a result, the pressing fixture 2*c* is firmly supported by the support pieces 16, thus effectively improving stability when suspending and holding the buckle-type belt 2.

The following describes other configurations for suspending and holding the buckle-type belt 2. First, in the present embodiment, the support pieces 16 are provided in an intermediate portion of the support member 13 with respect to the vertical direction. The extent of bending is higher in the vertical intermediate portion of the support member 13 than in the end portions of the support member 13, thus making it possible to increase the clamping force that is applied to the pressing fixture 2*c* by the support pieces 16.

The pairs of upper and lower support pieces 16 are approximately perpendicular to the support member 13, and therefore clamping force is favorably applied to the pressing fixture 2*c* by the support pieces 16.

Figure 8:
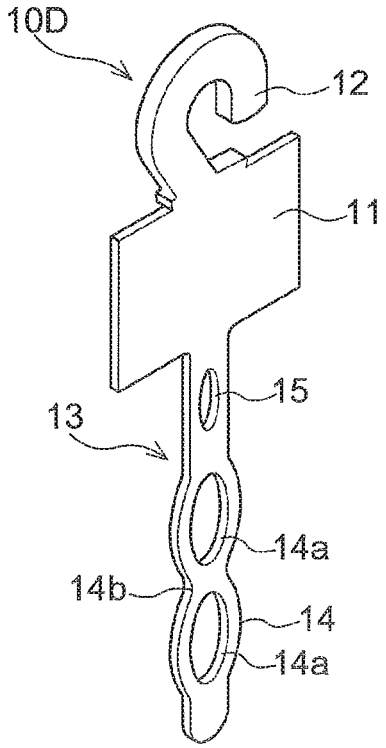
FIG. 8 is a perspective view of the back side of another belt hanger according to the second embodiment.

Note that although the belt hanger 10A not provided with a display portion for displaying an advertisement, a barcode, or the like is described in the present embodiment, it is possible to provide a flat plate-shaped display portion 11 between the hook portion 12 and the support member 13 as with the belt hanger 10B shown in FIG. 8, or provide the display portion 11 above the hook portion 12, for example. The arrangement of the display portion 11 and the hook portion 12 and the provision thereof can be changed as appropriate.

Note that as long as at least the first support portion 14 of the support member 13 has flexibility and elasticity, the belt hangers 10A and 10B may be made of various materials such as a metal or a resin according to the application.

Second Embodiment

A second embodiment of a belt hanger according to the present disclosure will be described below with reference to the drawings. In the present embodiment, the configuration of the support member 13 is different from the first embodiment. The following description of belt hangers 10C, 10D and 10E according to the present embodiment focuses mainly on differences from the first embodiment. Note that configurations not described in particular are similar to the first embodiment and are denoted by the same reference signs, and will not be described in detail.

Figure 7:
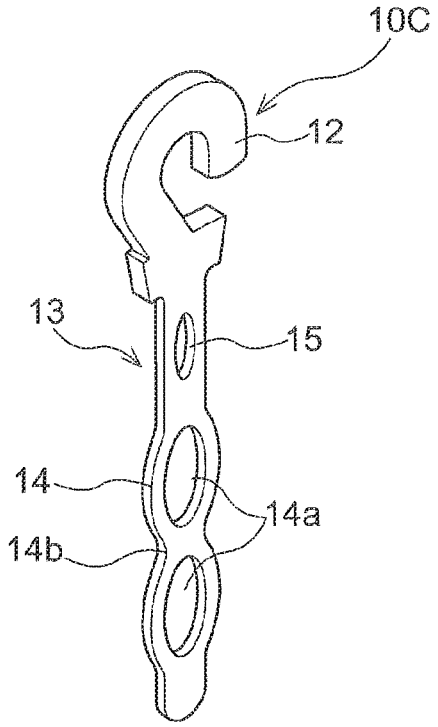
FIG. 7 is a perspective view of the back side of the belt hanger according to the second embodiment.

As shown in FIG. 7, the belt hanger 10C is not provided with the support pieces 16.

Although the belt hanger 10C does not have the display portion 11, a flat plate-shaped display portion 11 may be provided above the hook portion 12, or the display portion 11 may be provided between the hook portion 12 and the support member 13 as with the belt hanger 10D shown in FIG. 8, for example. The provision of the display portion 11 and the arrangement thereof can be changed as appropriate.

Figure 9:
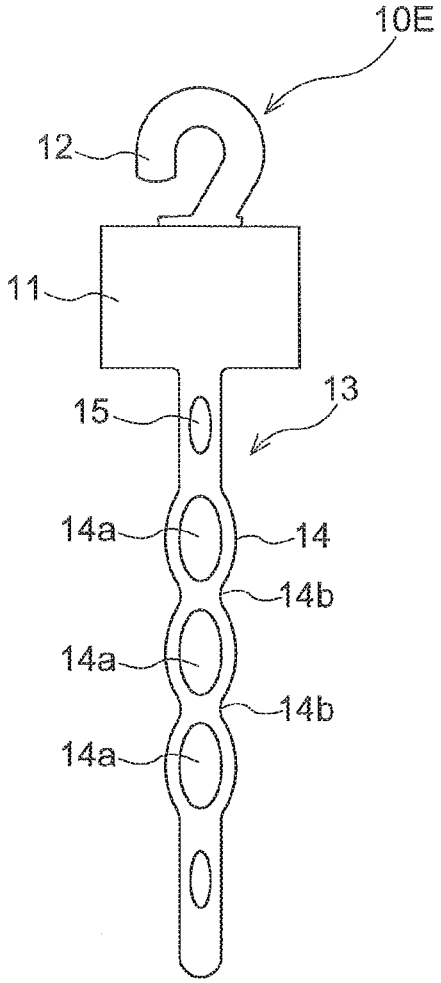
FIG. 9 is a front view of yet another belt hanger according to the second embodiment.
Figure 10:
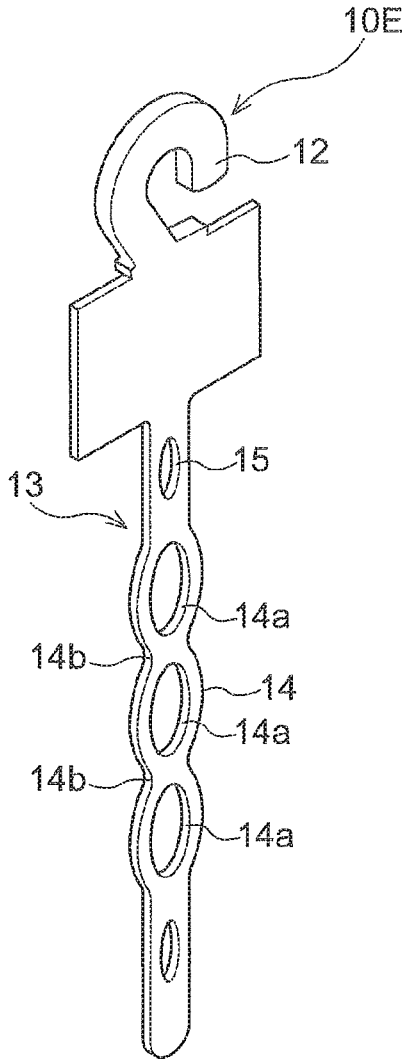
FIG. 10 is a perspective view of the back side of the yet another belt hanger according to the second embodiment.

Also, in order to be able to accommodate the case where the locking pin 1*c* of the pin-type belt 1 is long, it is possible to provide three through holes 14*a* and increase the length of the first support portion 14 as with a belt hanger 10E shown in FIGS. 9 and 10, or to increase the number of through holes 14*a* to three or more and increase the length of the first support portion 14, for example.

Other Embodiments

The above embodiments describe configurations in which the first support portion 14 is provided with two through holes in the surface of a flexible plate-shaped member. However, the embodiments of the present disclosure are not limited to this, and it is possible to provide two or more through holes, or support the locking pin 1*c* by a configuration other than through holes. For example, there is no limitation to using through holes, and a configuration is possible in which a plurality of loop-shaped members that are open in the length direction are provided in the surface of a plate-shaped member, and the locking pin 1*c* is inserted into these members such that a plurality of portions of the locking pin are simultaneously supported. Alternatively, a configuration is possible in which the first support portion 14 is a tube-shaped member, and the locking pin 1*c* is inserted into this tube-shaped member such that a plurality of portions of the locking pin are simultaneously supported.

Also, the configuration of the second support portion are not limited to the configurations described in the above embodiments. There are no particular limitations on the shape, arrangement, and the like of the support pieces 16 as long as the pressing fixture 2*c* can be arranged between a pair of upper and lower support pieces 16, and the pair of upper and lower support pieces are separated at a distance according to which the pressing fixture 2*c* can be clamped between the pair of upper and lower support pieces 16 in the state where the support member 13 is bent into an arc shape with the support pieces 16 on the inward side. For example, the support pieces may be provided in an end portion rather than the vertical intermediate portion of the support member 13, or may be provided so as to be bent relative to the support member support member rather than being approximately perpendicular. Also, the pair of upper and lower support pieces 16 does not need to be provided on both the left and right sides of the through holes 14*a*.

Furthermore, a configuration is possible in which the support member 13 is provided with only the first support portion 14, and the provision of the first support portion 14, the second support portion can be selected as appropriate.

Regarding the other configurations as well, the embodiments disclosed in this specification are illustrative in all aspects, and it is to be understood that the scope of the present disclosure is not limited by these embodiments. It will be easily understood by a person skilled in the art that appropriate modifications can be made without departing from the gist of the present disclosure. Accordingly, other embodiments achieved by modifications made without departing from the gist of the present disclosure are of course also encompassed in the scope of the present disclosure.

Summary of Embodiments Described Above

A Brief Summary of a Belt Hanger Described Above is Provided Next.

A belt hanger according to an aspect of the present embodiment is a belt hanger including a support member capable of supporting at least a locking pin of a pin-type belt that includes a single-pin buckle, the belt hanger suspending and holding the pin-type belt by supporting the locking pin with use of the support member, wherein the support member includes a first support portion capable of simultaneously supporting a plurality of portions of the locking pin that are separated in a length direction of the locking pin.

According to this configuration, a plurality of portions of the locking pin in the length direction are supported by the first support portion, and therefore it is possible to effectively suppress swinging of the belt hanger about the support point relative to the belt. Also, there is no need to provide a fold-back portion as in conventional technology, thus making it possible to achieve size reduction, cost reduction, and an improvement in durability. Accordingly, it is possible to achieve size reduction and cost reduction while also improving durability and usability for store employees, customers, etc. (ease of belt attachment and removal, low tendency of swinging, low tendency of falling during transport, etc.).

In another aspect, it is preferable that the first support portion includes a flexible plate-shaped member and at least two through holes that are provided in a surface of the plate-shaped member and are arranged side-by-side in the length direction of the locking pin, and the first support portion supports a plurality of portions of the locking pin in the length direction, when the locking pin is in a state of being inserted into a lower through hole out of the two through holes from a first side to a second side, and then inserted into an upper through hole out of the two through holes from the second side to the first side such that the locking pin is inserted through each of the two through holes.

According to this configuration, the first support portion can have a simple configuration in which merely through holes are provided in a plate-shaped member.

In another aspect, it is preferable that a length of each of the through holes in the length direction is larger than a thickness of the locking pin.

In order to insert the locking pin through the lower through hole from the first side to the second side, and then insert the locking pin through the upper through hole from the second side to the first side, it is necessary to bend the portion between the two through holes, and if the length of the through holes is the same as the thickness of the locking pin (the thickness in the direction perpendicular to the buckle in the state where the leading end of the locking pin is arranged in the buckle), the locking pin needs to be inserted perpendicular to the through holes, and thus the portion between the through holes needs to be bent 180 degrees. In this case, the operation of attaching the belt hanger to the belt is difficult, the load applied to the support member increases, and the durability of the belt hanger decreases. In contrast, according to the above configuration, the length of each of the through holes is longer than the thickness of the locking pin, and therefore the locking pin can be inserted while being inclined relative to the through holes, and the bending angle of the portion between the through holes can be reduced. Accordingly, the operation of attaching the belt hanger to the belt can be performed more easily, and it is possible to improve the durability of the belt hanger.

In another aspect, it is preferable that a portion of the first support portion between the two through holes decreases in width along a shape of the through holes.

According to this configuration, the portion between the through holes has a decreased width, thus facilitating bending of the portion between the through holes and making it possible to facilitate performing the operation of attaching the belt hanger to the belt. Also, when removing the belt hanger, the portion between the through holes can be easily pinched from the left and right sides, thus facilitating removal of the belt hanger.

In another aspect, it is preferable that the support member includes a second support portion that can support a pressing fixture of a buckle-type belt, the buckle-type belt including a buckle, a belt, and the pressing fixture that sandwiches the belt along with the buckle and fixes the belt to the buckle by pressing the belt against the buckle.

A belt hanging structure according to an aspect of the present embodiment is a belt hanging structure that suspends and holds a pin-type belt that includes a single-pin buckle with use of the above-described belt hanger according to the present embodiment, the support member supporting a plurality of portions of a locking pin of the pin-type belt that are separated in a length direction of the locking pin.

According to this configuration, a plurality of portions of the locking pin in the length direction are supported by the support member, and therefore it is possible to effectively suppress swinging of the belt hanger about the support point relative to the belt. Accordingly, it is possible to improve usability for store employees, customers, and the like.

What is claimed is:

1. A belt hanger for supporting at least a locking pin of a pin-type belt that includes a single-pin buckle, the belt hanger comprising a support member capable of suspending and holding the pin-type belt by supporting the locking pin with the support member, wherein the support member comprises a first support portion capable of simultaneously supporting a plurality of portions of the locking pin that are separated in a length direction of the locking pin, wherein the first support portion of the support member includes a flexible plate-shaped member having a length, a width, a first side, and an opposite second side, the plate-shaped member having at least two through holes arranged side-by-side in the direction of the length of the plate-shaped member, and the first support portion being configured to support the plurality of portions of the locking pin in the length direction of the locking pin, when the locking pin is in a state of being inserted into a lower through hole out of the at least two through holes from the first side to the second side of the plate-shaped member, and then inserted into an upper through hole out of the at least two through holes from the second side to the first side of the plate-shaped member such that the locking pin is inserted through each of the at least two through holes.

2. The belt hanger according to claim 1, wherein a length of each of the through holes in the length direction is larger than a thickness of the locking pin.

3. The belt hanger according to claim 1, wherein a portion of the first support portion is between the at least two through holes and decreases in width along a shape of the through holes.

4. The belt hanger according to claim 1, wherein the support member further comprises a second support portion that can support a pressing fixture of a buckle-type belt, the buckle-type belt including a buckle, a belt, and the pressing fixture being configured to sandwich the belt along with the buckle and to fix the belt to the buckle by pressing the belt against the buckle.

5. The belt hanger according to claim 1, wherein the plurality of through holes include at least three through holes.

6. The belt hanger according to claim 1, wherein the plurality of through holes are elliptical having a major axis extending in the length direction of the plate-shaped member.

7. The belt hanger according to claim 1, wherein the plurality of through holes are ring-shaped.

8. The belt hanger according to claim 1, wherein the flexible plate-shaped member is formed of an elastomeric material and is configured to be deformable to facilitate insertion of the locking pin in the at least two through holes.

* * * * *